United States Patent [19]

Saunders

[11] Patent Number: 4,586,296

[45] Date of Patent: May 6, 1986

[54] METHOD OF FINISHING THE SURFACE OF A DISC

[75] Inventor: Jimmy G. Saunders, El Toro, Calif.

[73] Assignee: Charlton Associates, Irvine, Calif.

[21] Appl. No.: 627,437

[22] Filed: Jul. 3, 1984

[51] Int. Cl.[4] ..... B24B 1/00

[52] U.S. Cl. ..... 51/281 SF; 51/111 R; 51/118; 51/132

[58] Field of Search ..... 51/281 SF, 117, 118, 51/132, 111 R

[56] References Cited

U.S. PATENT DOCUMENTS

| | | | |
|---|---|---|---|
| 1,812,313 | 6/1931 | Arter et al. | 51/118 |
| 3,721,046 | 3/1973 | Dunn | 51/118 |
| 3,943,666 | 3/1976 | Dion et al. | 51/132 |
| 4,179,852 | 12/1979 | Barnett | 51/132 |
| 4,393,628 | 7/1983 | Ottman | 51/118 |

FOREIGN PATENT DOCUMENTS

| | | | |
|---|---|---|---|
| 611121 | 10/1960 | Italy | 51/118 |
| 249234 | 1/1970 | U.S.S.R. | 51/118 |

*Primary Examiner*—Frederick R. Schmidt
*Assistant Examiner*—J. T. Zatarga
*Attorney, Agent, or Firm*—Harvey C. Nienow

[57] ABSTRACT

The method of finishing the surface of a disc, such as a disc whereon information is magnetically recorded for use in computers and the like. It involves urging against one side of a rotating disc, a polishing pad having a polishing compound or medium thereon, and simultaneously urging a non-polishing pad against the opposite side of such disc in alignment with the polishing pad. To simultaneously polish the opposite side surfaces of the disc, a second pair of pads (one polishing and one non-polishing) is equiangularly spaced on the disc in relation to the first pair of pads, but the pads of the second pair of pads are reversed so as to cause the finishing process to occur on the disc side not being polished by the first pair of pads. Any desired even numbered pairs of pads may be employed.

The polishing and non-polishing pads are caused to rotate relative to and against the respective side of the disc as the disc itself is caused to rotate about its axis.

5 Claims, 5 Drawing Figures

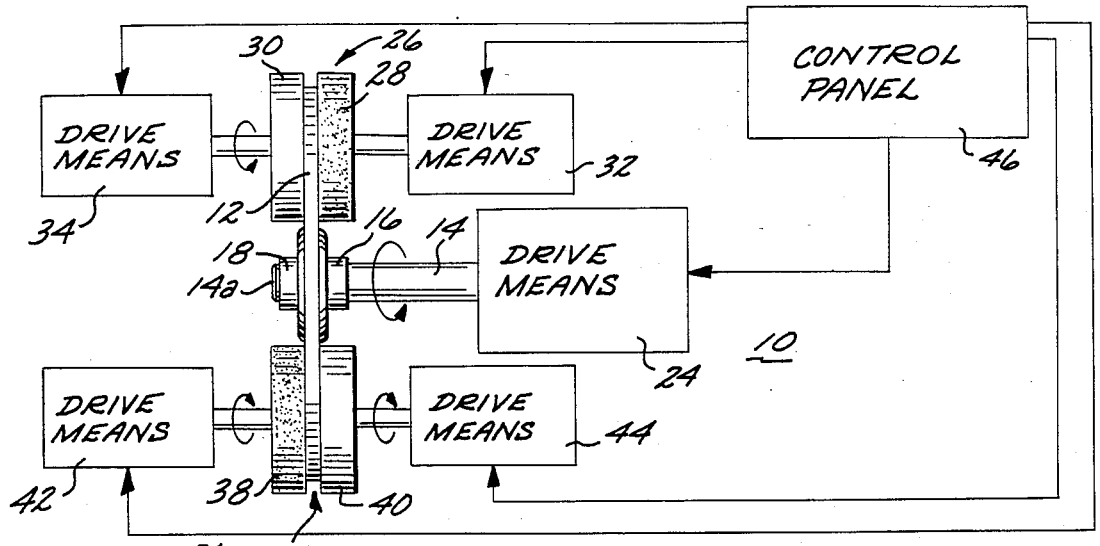
FIG. 1
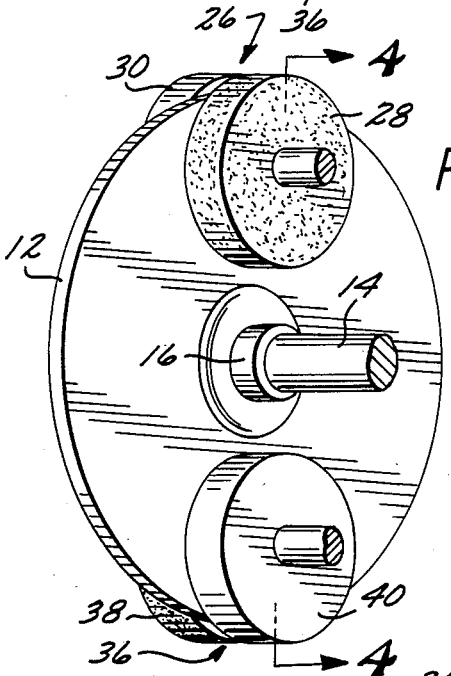
FIG. 2
FIG. 3
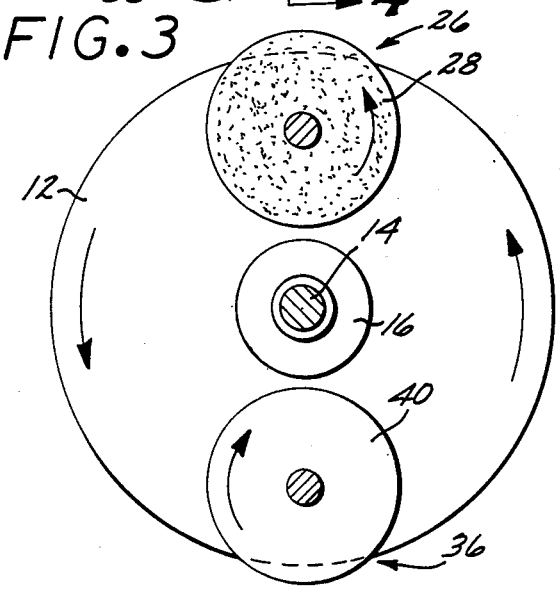
FIG. 4
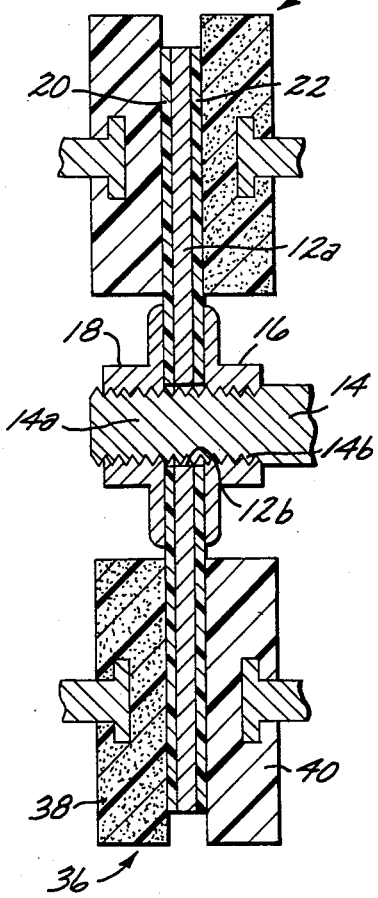
FIG. 5
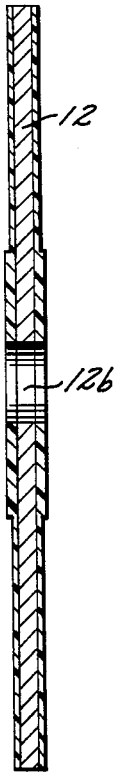

METHOD OF FINISHING THE SURFACE OF A DISC

The present invention relates generally to a method of finishing the surface of a magnetic disc, but more particularly to such a method wherein the amount of magnetic material removed can be controlled precisely.

BACKGROUND OF THE INVENTION

Within the past various decades, many different types of machinery and apparatus have been devised for magnetically recording information on a suitable track or disc. With the advent of inexpensive computers for home, office and industry use, a demand has developed for magnetic discs which are very precise in construction and operation when employed to store information of virtually any kind of description.

In the manufacture of rigid memory discs, a flat substantially co-planar ring of aluminum is coated with an expoy-based matrix having therein a predetermined amount of magnetically sensitive particles. Typically, such coating is applied to the opposite sides of the aluminum ring so that both sides are capable of carrying information.

The epoxy matrix is cured, and thereafter the opposite surfaces of the disc are polished or ground to provide the required surface finish. To ensure that each such disc surface is capable of retaining information and transferring the same to other discs or devices, it is necessary that the thickness of the coating on each side of the disc be within certain predetermined limits.

Prior polishing or grinding methods have employed the use of polishing pads which were simultaneously brought to bear against the opposite side surfaces of the disc in substantial alignment with each other so that both surfaces are polished at the same time as the disc is rotated. This arrangement many times resulted in one side of the disc being ground or polished too much and the opposite side being ground or polished too little, the aluminum body of the disc thereby being located off center with respect to the coatings on the opposite sides. This has been deemed to be unsatisfactory because, although the total thickness of the disc might be maintained within predetermined limits, the thicknesses of the coatings themselves were unequal and usually not within the prescribed tolerances.

OBJECTS OF THE INVENTION

It is an object of the present invention to provide a method whereby a rigid two-sided disc can be polished or finished such that the desired total thickness of the disc as well as the desired thickness of the magnetic coatings on opposite sides thereof are maintained within prescribed limits.

Another object of the present invention is to provide a method for finishing discs as characterized above whereby the finishing of the opposite sides can take place simultaneously while nonetheless maintaining proper coating thickness of the magnetizable material.

A still further object of the present invention is to provide a method of finishing discs as characterized above, wherein a pair of oppositely disposed pads are employed for grinding or finishing one surface and a similar pair of pads are employed for finishing the opposite side of the disc.

Another still further object of the present invention is to provide a method of finishing a magnetizable memory disc as characterized above, wherein the disc itself is rotated while the pairs of pads are rotated and brought into engagement with such disc at equiangular positions about its axis of rotation.

Another feature object of the present invention is to provide or teach a method of finishing a memory disc which is simple and inexpensive to employ and which is substantially error proof and effective.

BRIEF DESCRIPTION OF THE DRAWINGS

The novel features which I consider characteristic of my invention are set forth with particularity in the appended claims. The invention itself, however, both as to its organization and mode of operation, together with additional objects and advantages thereof, will best be understood from the following description of specific embodiments when read in connection with the accompanying drawings, in which:

FIG. 1 is a schematic showing of a finishing method according to the present invention;

FIG. 2 is a fragmentary perspective view of the disc being polished in the system of FIG. 1;

FIG. 3 is a side elevational view of the apparatus of FIG. 2;

FIG. 4 is a fragmentary sectional view taken substantially along line 4—4 of FIG. 2; and FIG. 5 is a sectional view through a disc the opposite sides of which have been finished in accordance with the present invention.

Like reference characters indicate corresponding parts throughout the several views of the drawings.

DESCRIPTION OF THE PREFERRED EMBODIMENT

Referring to FIG. 1 of the drawings, there is shown therein a system or apparatus 10 for carrying out the subject method for polishing memory discs. The disc to be polished is shown at 12 and is mounted on a mandrel 14 by means of collars 16 and 18. The end **14*a* of mandrel 14 is formed with external fastening threads 14*b* for receiving the internally threaded collars 16 and 18, as shown most particularly in FIG. 4** of the drawings.

As also shown in FIG. 4, the disc 12 comprises a ring **12*a* which may be formed of substantially any material such as aluminum or alloys thereof, or any other non-magnetic rigid material. As shown in FIGS. 2 and 3 of the drawings, the aluminum is provided with a ring shape so as to have a central opening 12*b* which is capable of receiving the threaded end portion 14*a* of mandrel 14**.

Disc 12 is provided with coatings 20 and 22 of an epoxy based matrix wherein extremely fine magnetizable particles are immersed so that the disc 12 is thereby provided with opposite side surfaces which are magnetizable with any appropriate information.

As shown most particularly in FIG. 4 of the drawings, in practicing the present method, the disc 12 is firmly held between the threaded collars 16 and 18 so that the disc 12 will rotate with the mandrel.

Suitable drive means 24 is provided for rotating mandrel 14 and disc 12 at a predetermined speed related to the amount of material to be removed during the finishing process of the disc, as will hereinafter be explained in greater detail.

A pair 26 of pads 28 and 30 are positioned on opposite sides of the disc 12 in substantial alignment with each other along an axis which is spaced a fixed predetermined distance from the axis of rotation of mandrel 14.

Pad 28 is a finishing pad, being provided with a finishing compound of substantially any desired formulation. Such finishing compound or medium may be provided on the surface of the pad 28 or may be dispersed throughout such pad, to provide a grinding or cutting operation when urged against the surface of moving disc 12.

The pad 30 in alignment with pad 28 is substantially free of any grinding or cutting material and therefore constitutes merely a backup or reaction member to the force applied to disc 12 by pad 28. Thus, as disc 12 is caused to rotate, whereas the finishing pad 28 will cut into and remove material from the corresponding surface disc 12, the pad 30 opposite thereto will not remove material from the disc, but rather merely acts as a backup against the force applied by pad 28 to disc 12.

As shown in FIG. 1 of the drawings, suitable drive means 32 is provided for rotating the finishing or polishing pad 28 and, a suitable drive means 34 is provided for rotating non-polishing pad 30. In this way, the forces applied to the disc are substantially equal though opposite so that the entire polishing function can take place under controlled conditions.

A second pair 36 of pads 38 and 40 is provided for grinding, polishing or finishing the other side of disc 12. That is, pad 38 is provided with the polishing medium or compound and is caused to bear against the surface of disc 12 which is opposite the surface engaged by pad 28, as above described. Although not mandatory for successful practice of the instant invention, it is desirable that the polishing pads 28 and 38 be substantially identical in construction, including the amount of polishing compound or medium contained therein. Also, the pairs 26 and 36 of such pads should be substantially equiangularly spaced about the axis of rotation of mandrel 14 to insure the proper application of forces to the disc 12 while it rotates.

Drive means 42 is provided for rotating finishing pad 38 and drive means 44 is provided for rotating non-finishing pad 40, the latter of which is similar in substantially all regards to the non-finishing pad 30, hereinabove described.

To provide optimum automation and grinding or polishing results, a control apparatus 46 may be provided whereby each of the aforementioned drive means may be individually controlled as to the speed of rotation of the disc or pads, respectively. Also, there may be provided, for optimum automatic operation of the method herein, suitable force-generating means (not shown in the drawings) which may take the form of mechanical or hydraulic apparatus for urging the pads of each pair toward the disc with the same amount of force. Thus, the controls represented by control panel 46 of FIG. 1 can be adjusted as desired.

In effectuating the desired polishing or finishing operation, it is merely necessary to cause drive means 24 to rotate mandrel 14 and disc 12 at the desired speed. Although the individual polishing or finishing pads might not have to rotate under certain circumstances, for precise finishing of the disc 12, it is desirable that such pads rotate as shown in the drawings.

In the event that considerably more magnetic coating material has been applied to one side of the disc 12 than the other, it is merely necessary to cause a greater grinding or polishing effort to be applied to the thicker side by varying appropriately the amount of force applied to that side through the appropriate polishing pad, or by increasing the speed of rotation thereof, as the case may be. In any event, it is contemplated within the scope of this invention that the control means for these variables can be employed to make suitable adjustment to accomplish the intended and desired result. Other variables will be readily apparent to those persons skilled in the art such as the length of time that the respective pads are in contact with their particular disc surface, in order to thereby vary the grinding or polishing effect on the different surfaces.

It is contemplated that, for best results, any appropriate or desired even number pairs of pads may be employed, and to be equiangularly spaced about the axis of rotation of the disc 12 to optimize the balancing effects of the various forces as applied to the disc during the method herein described. With such arrangement, the grinding effect at each pair of pads can be isolated from the various parameters at the other pairs so that the ultimate grinding and polishing effects can be controlled most precisely.

Although I have shown and described certain specific embodiments of my invention, I am well aware that many modifications thereof are possible. The invention, therefore, is not to be restricted except insofar as is necessitated by the prior art and by the spirit of the appended claims.

I claim:

1. A method of finishing the opposite sides of a substantially coplanar disc comprising the steps of:

rotating the disc at a predetermined speed, contacting simultaneously each of the opposite sides of said disc with a polishing pad having a polishing medium thereon but at locations on said disc which are spaced the same distance from the axis of rotation of the latter and which are symmetrically located relative to the axis of rotation of said disc, and contacting each of said opposite sides of said disc with a pad free of polishing medium at a location on said disc opposite to the respective polishing pad.

2. A method of finishing a disc according to claim 1 wherein said polishing medium is a grit capable of cutting into the respective surface of said disc.

3. A method of finishing a disc according to claim 2 wherein said polishing pads are caused to rotate relative to said disc as the latter is rotated on its axis.

4. A method of finishing a disc according to claim 3 wherein said pads are caused to rotate against and relative to the respective sides of said disc, and a predetermined force is applied to said disc from said opposed pads.

5. A method of finishing a disc according to claim 4 wherein the pairs of opposed pads are equi-angularly spaced about the axis of rotation of said disc.

* * * * *